United States Patent [19]

Lux et al.

[11] 4,195,830

[45] Apr. 1, 1980

[54] GUIDING DEVICE FOR SEWING MATERIAL

[75] Inventors: Hans W. Lux, Kaiserslautern; Erich Willenbacher, Rheinstetten, both of Fed. Rep. of Germany

[73] Assignee: Pfaff Industriemaschinen GmbH, Fed. Rep. of Germany

[21] Appl. No.: 972,341

[22] Filed: Dec. 22, 1978

Related U.S. Application Data

[62] Division of Ser. No. 811,148, Jun. 28, 1977, Pat. No. 4,140,068.

[30] Foreign Application Priority Data

Jul. 30, 1976 [DE] Fed. Rep. of Germany ... 7623947[U]

[51] Int. Cl.[2] ..... B65H 7/00

[52] U.S. Cl. ..... 271/8 R; 112/121.26; 112/121.15; 226/195; 226/196

[58] Field of Search ..... 112/121.26, 121.11, 112/121.15, 207; 271/8 R, 264; 273/11 R

[56] References Cited

U.S. PATENT DOCUMENTS

| | | | |
|---|---|---|---|
| 1,693,116 | 11/1928 | Lee | 273/11 R |
| 3,867,889 | 2/1975 | Conner, Jr. | 112/121.11 |
| 3,903,818 | 9/1975 | Marjorio | 112/121.26 |
| 4,013,025 | 3/1977 | Marjorio | 112/121.26 |
| 4,036,156 | 7/1977 | Becker et al. | 112/121.26 |

*Primary Examiner*—H. Hampton Hunter
*Attorney, Agent, or Firm*—McGlew and Tuttle

[57] ABSTRACT

A material guiding device for feeding material to a stitch-forming area of a sewing machine which has a rail guide over which the material is placed for guiding movement from a charging point to the stitch-forming area, comprises a braking weight which has a bottom recess of a size to receive the rail guide with the material thereon so as to permit engagement of the weight over the material so as to move with the material during the feeding operation and to provide a braking action thereon. The construction includes a deflector adjacent the stitch-forming area which deflects the weight into a braking weight return track in the form of a slide or chute which has an opening adjacent the stitch-forming area and is inclined downwardly to a delivery end which is remote from the stitch area at the charging point for the material so that a weight may be returned automatically to a place at which it may be applied to a material at the charging point. The braking weight advantageously includes pins which extend into the recess and engage the material to secure the braking weight to the material for movement therewith during feeding. The braking force may be increased by designing the weight or the track with a magnetic attractable material so as to increase the attracting force between the brake and the guide rail.

5 Claims, 3 Drawing Figures

GUIDING DEVICE FOR SEWING MATERIAL

This is a division of application Ser. No. 811,148, filed June 28, 1977 now U.S. Pat. No. 4,140,068, dated Feb. 20, 1979.

FIELD AND BACKGROUND OF THE INVENTION

This invention relates in general to sewing machines and, in particular, to a new and useful guiding device for sewing material fed to the stitch-forming area of a sewing machine on which a clamping device, displaceable along a guide rail and which determines the form of the seam acts on the end of the device.

DESCRIPTION OF THE PRIOR ART

Guiding devices for sewing materials are known, wherein an adjustable guide rail for forming straight or curved seams is arranged in front of the stitch-forming area which forms a guideway for a clamping device which moves on the latter. The clamping device has a rigid and resilient clamp leg, between which the rear end of the sewing material to be fed to the stitch-forming area on a path determined by the form of the guide rail is introduced by hand and held clamped. The clamping device is entrained by the sewing material fed to the stitch-forming area by feeding device, and thus exerts a braking action to keep the sewing material stretched, and controls the material since it is displaced corresponding to the form of the guide rail transverse to the feeding direction. A limit switch is provided which is close to the end of the guide rail and in front of the stitch-forming area. The limit switch provides means for disconnecting the sewing machine and the synchronously driven feeding tools, and also for stopping the machine at a distance in front of the stitch-forming area by disconnecting it before the needle reaches the end of the seam. The remaining seam length must therefore be produced while the machine runs down, and the workpiece is pulled out from the clamping device.

The introduction of the range of the rear edge of the sewing material into the clamping device requires some attention, and special care is required regarding the depth of introduction of the lateral edge of the workpiece, because the distance of the seam from the lateral edge depends on it, and distortions of the material can not be excluded, the same as when it is pulled out before the end of the seam. A certain uncertainty also exists in the production of the remaining length of the seam when the machine runs down. The latter can vary in time, depending on the temperature. For this reason, it is possible that the seam is not finished up to the end of the sewing material or that the machine sews beyond the end of the sewing material. Finally, the clamping device in this guiding device must be returned on the guide rail into its starting position by the operator at the end of the sewing operation, before the next workpiece can be applied on the sewing table, aligned, and introduced in the range of its end into the clamping device.

SUMMARY OF THE INVENTION

The present invention provides guide means and means for replacing a clamping device which runs thereon by a means that is simpler to handle and which is effective to return it automatically to the charging point at the end of the sewing operation. The construction also simplifies the handling of the sewing material during the preparation for the return to the stitch-forming area.

In accordance with the invention, the clamping device is designed as a braking weight to be attached on a guide rail with the interposition of the sewing material, and to be moved on the rail. The device includes a deflector which leads the braking weight to a return track which is inclined back to the charging point of the sewing material so that the weight returns by gravity.

The operator must only place the spherical braking weight astride on the sewing material and over the guide rail after placing the workpiece on the feed table in front of the sewing machine occupied by the guide rail, and to start the machine. Everything else runs automatically. The weight of the braking weight keeps the sewing material slightly pressed against the guide rail. The braking weight removed from the sewing material entrained by the workpiece exerts a braking force on the sewing material which suffices to keep it slightly stretched. Shortly before reaching the stitch-forming area, the braking weight is conducted by a deflector to the return track which comprises a tube. The weight rolls back automatically to the charging point and is therefore readily accessible. In this way, it is possible to work with several braking weights working in an overlapping manner, since the workpiece which follows is already placed on the feed table during the ongoing sewing operation, and its end is aligned and clamped on the guide rail by a second braking weight. At the end of the ongoing sewing operation, it is merely necessary to bring the head of the workpiece over a shaped web under the sewing foot before the next sewing operation can start.

It is of particular advantage for the return and use of the braking weight in the production of curved seams if a ball with two surfaces for guidance on the guide rail is provided as a braking weight. To ensure that the braking weight is entrained by the sewing material, it is provided with needles which penetrate with the points into the material.

In order to increase the braking action of the workpiece, the braking weight is advantageously equipped with a permanent magnet.

Accordingly, an object of the invention is to provide an improved guiding device for the sewing material which is fed to a stitch-forming area of a sewing machine, wherein the material is fed over a guide rail and which includes a braking weight which is engageable over the material in the guide rail which includes a return track for the braking weight arranged adjacent the stitch-forming area and inclined backwardly to a charging point so that the weight may be returned for reapplying to a separate section of material or to a new material which is being fed.

A further object of the invention is to provide a material guiding device for a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figures 1, 2, 3:
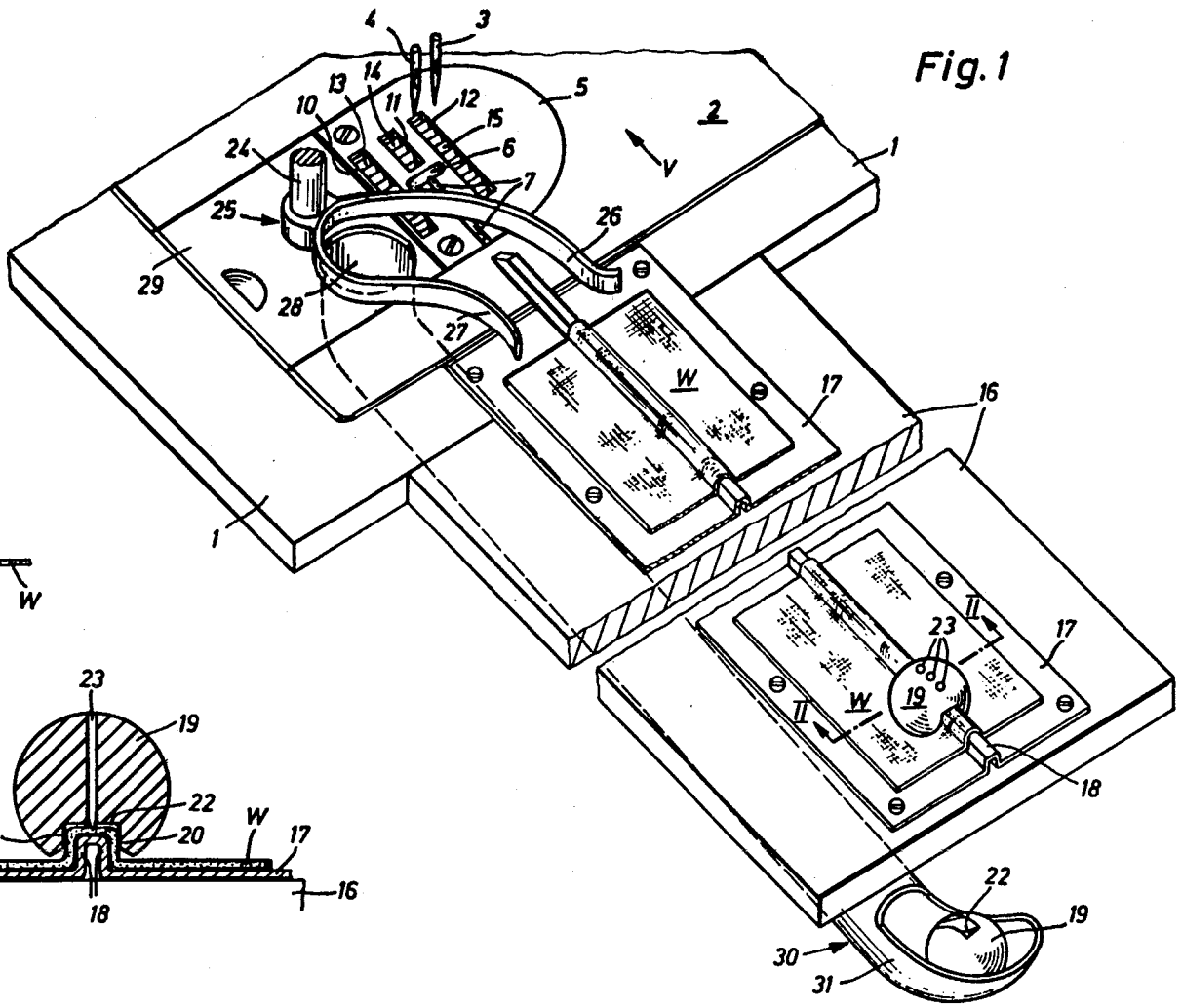
FIG. 1 is a simplified perspective view of the guiding device with braking weight, deflector and return track in front of the stitch-forming area of a sewing machine, which is equipped with sewing tools for sewing a piping and constructed in accordance with the invention.
FIG. 2 is a section taken along the line II—II of FIG. 1.
FIG. 3 is a sectional view of the piping guide on the stitch plate and sewing foot.

Referring to the drawing in particular, the invention embodied therein, comprises a guiding device for sewing material W which is to be fed to a stitch-forming area of a sewing machine 2. Sewing machine 2, which is only partially shown, is inserted into the table top of a frame and has two needles 3 and 4, which cooperate with a single looper (not shown) arranged under a stitch plate 5 for the formation of a seam formed of two upper threads and a common lower thread (stitch type 302 or 402). In front of slot 6 for the passage of the needles 3 and 4 and on stitch plate 5, is a shaped strap or projection 7 which forms, together with a recess 8, in a presser foot 9, shown only in FIG. 3, a piping guide for sewing material W. A piping seam produced with these sewing tools serves to produce permanent folds on trouser parts of knitted materials.

The toothed webs 13, 14 and 15 of a usual material feed of the sewing machine engage the sewing material W through respective slots 10, 11 and 12 of stitch plate 5 to displace it past the stitch-forming area over slot 6.

In order to guide the sewing material corresponding to the form of the seam, the device includes material guide means, which in the represented embodiment, comprises a straight guide rail. A curved guide rail is required for the production of curved seams, or ornamental piping seams. For example, the shaped bar can also be a curved plate 17 with a U-shaped or bent guide rail, such as rail 18. The guide rail 18 is screwed on feed table 16 over which the sewing material W comes to lie in the preparation for feeding to the stitch-forming area.

A braking weight 19, of spherical shape, is provided with a groove 22 bounded by two lateral surfaces 20 and 21. The weight 19 is equipped with three needles 23 whose points protrude slightly into groove 22. The weight 19 can be attached astride on the sewing materials W and the guide rail 18, after the sewing material has been placed on feed table 16 and has been aligned according to certain markings. As shown in the drawings, the weight is applied in such a manner that the points of the needles 23 engage the material to ensure the entrainment of the braking weight 19 by the sewing material W during its displacement. A displacement of the sewing material W transverse to the sewing direction is prevented by the lateral surfaces 20 and 21 of groove 22 and guide rail 18.

In order to increase the braking action, braking weight 19 or the guide rail 18 is advantageously equipped with a permanent magnet or is formed with magnetic material or is constructed so that magnetic force also acts as a braking force on the workpiece, apart from the friction during the operation and return of the workpiece.

Fork ends or legs 26 and 27 protrude into the path of motion of braking weight 19 forming an inlet opening of a deflector 25 mounted on the machine casing for swiveling about a supporting bar 24 between two end positions limited by stops, or a switch (not shown). The fork legs 26 and 27 form a guideway for braking weight 19, which extends over an opening 28 in cloth support feed 29, into which protrudes a return track 30 formed of a tube. The return track 30 is slightly inclined toward a feed table 16 which is the charging point for the sewing material. The track 30 is dish-shaped at an end 31 which projects beyond the end of the feed table 16 to retain and receive the braking weight 19. There is sufficient room for several braking weights at the dish-shaped end 31.

The mode of operation of the guiding device is as follows:

After a workpiece W has been placed on feed table 16 over plate 17 and guide rail 18 and has been aligned according to certain criteria, and has been introduced with its head corresponding to FIG. 3 onto the piping guide or bar 7 under recess 8 of the presser foot 9, a braking weight 19 in the dish-shaped end 31 is placed astride the workpiece W close to its end terminal edge and over guide rail 18 in such a way that a U-shaped piping is formed around guide rail 18, which is supported laterally by the surfaces 20 and 21 of the groove 22 and the points of the needles 23 penetrate into the material, as shown in FIG. 2. The workpiece W is displaced in the direction of arrow V of FIG. 1, after the sewing machine has been started by the action of the material feed or by its toothed webs 13, 14 and 15 engaging the underside of the workpiece. The feeding produces a piping fold which is fixed by a three-threaded seam, stitch type 302 or 402, as a permanent fold.

During the displacement, the braking weight 19 exerts a braking force, due to its own weight and the friction between the material and guide rails, which suffices to keep the workpiece slightly stretched in a sewing direction. The braking force is increased further if braking weight 19 is equipped with a permanent magnet.

Due to the use of a braking weight as a clamping device, which can be attached on guide rail 18 with the interposition of the sewing material, it is no longer necessary to wait for the end of the ongoing sewing operation. The next workpiece can be placed on feed table 16 during the ongoing sewing operation, aligned with its end region, and be clamped in its aligned position on guide rail 18 by an additional braking weight, so that preparations can be carried out during the machine time, and an overlapping procedure is possible.

At the end of guide rail 18, in front of the stitch-forming area, braking weight 19 runs off guide rail 18 into the guide track formed by the fork legs 26 and 27 of deflector 25 and is deflected to the opening 28 into return tube 30, in which it rolls back to the dish-shaped end 31 at the charging point of the sewing material. The threads are cut off at the end of the seam after the machine has been stopped briefly; the sewing machine is shutoff with the needles in raised position, and the presser foot is lifted. The next sewing operation may be started as soon as the head of the workpiece has been placed over shaped bar 7 and presser foot 9 has been lowered.

While a specific embodiment of the invention has been shown and described in detail to illustrate the application of the principles of the invention, it will be understood that the invention may be embodied otherwise without departing from such principles.

What is claimed is:

1. A material guiding device, comprising a bar over which the material is to be moved, said bar extending longitudinally of the path of movement of the material, and a braking weight having a surface with a bar receiving groove of slightly greater dimension than said bar engageable over the material and the bar so that the bar with the material engages in the groove, said braking weight acting to hold the material over the bar and being slidable with the material along said bar.

2. A material guiding device according to claim 1, including a platform having a surface over which the material is to be moved, said bar projecting upwardly from the surface of said platform, the material being positionable on the platform so that it overlies said bar.

3. A material guiding device according to claim 1, wherein said braking weight has a bore therethrough extending into said groove, and a needle extending through said bore into engagement with the material positioned over the bar in said groove.

4. A material guiding device according to claim 1, wherein said braking weight has a needle point portion projecting into said groove engageable with the material to entrain the material to the braking weight.

5. A material guiding device according to claim 1, wherein said braking weight includes a magnetic portion.

* * * * *